United States Patent [19]

Gnesa

[11] Patent Number: 4,684,289

[45] Date of Patent: Aug. 4, 1987

[54] ROAD COATING METHOD AND APPARATUS

[76] Inventor: Edward C. Gnesa, 160 Patterson Rd., Santa Maria, Calif. 93455

[21] Appl. No.: 874,033

[22] Filed: Jun. 13, 1986

[51] Int. Cl.[4] ..... E01C 19/48

[52] U.S. Cl. ..... 404/75; 404/94; 404/93

[58] Field of Search ..... 404/73, 75, 82, 93, 404/94, 101; 427/136, 137, 138, 139

[56] References Cited

U.S. PATENT DOCUMENTS

| | | | |
|---|---|---|---|
| 3,874,806 | 4/1975 | Grist et al. | 404/93 |
| 3,886,011 | 5/1975 | Eigenmann | 404/94 X |
| 4,376,007 | 3/1983 | Eigenmann . | |
| 4,555,073 | 11/1985 | Barazone | 404/94 X |

*Primary Examiner*—William F. Pate, III

*Assistant Examiner*—Creighton Smith

*Attorney, Agent, or Firm*—Kenneth J. Hovet

[57] ABSTRACT

A truck having a road oil spreader is equipped with an apparatus for simultaneous application of oil and paving fabric to the road surface. The apparatus includes an assembly for engaging a roll of paving fabric comprising adjustable cone arms mounted on a collapsible boom that rotatably hold the core section of the fabric roll. The fabric is drawn over an idler shaft and beneath a series of longitudinally aligned brushes. The shaft and brushes are connected to each opposing end of the oil spreader by a removable outwardly extending side framework. The framework includes joint and connection means that permit longitudinal and angular adjustment of the idler shaft and brushes. As oil is sprayed over the road surface, the fabric unrolls and becomes embedded in the oil by action of the brushes pushing the fabric into the oil-coated surface.

20 Claims, 14 Drawing Figures

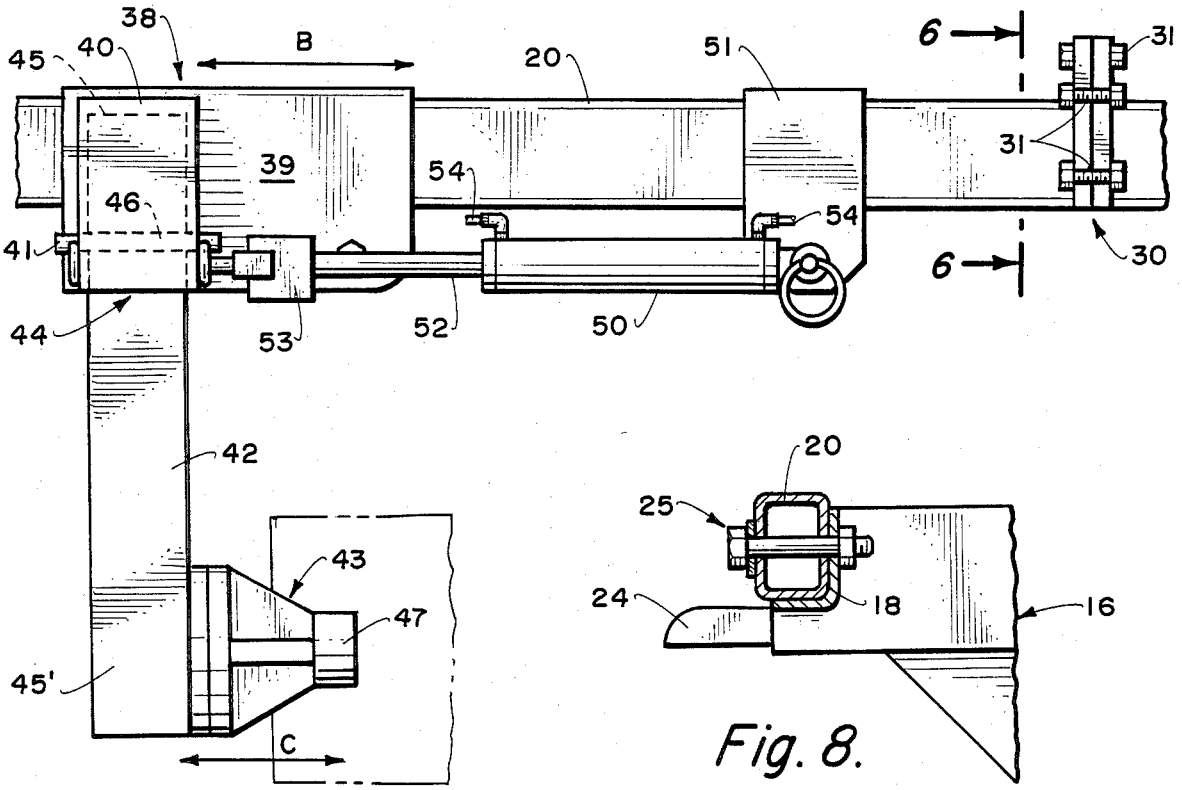
Fig. 5.
Fig. 8.
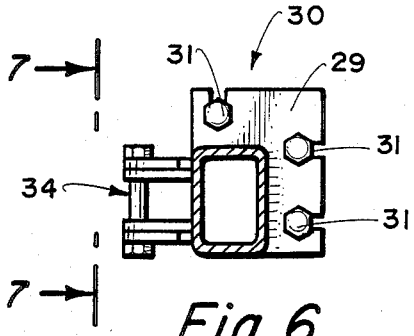
Fig. 6.
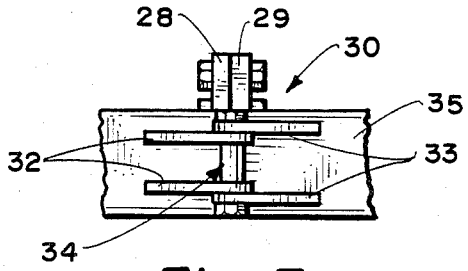
Fig. 7.
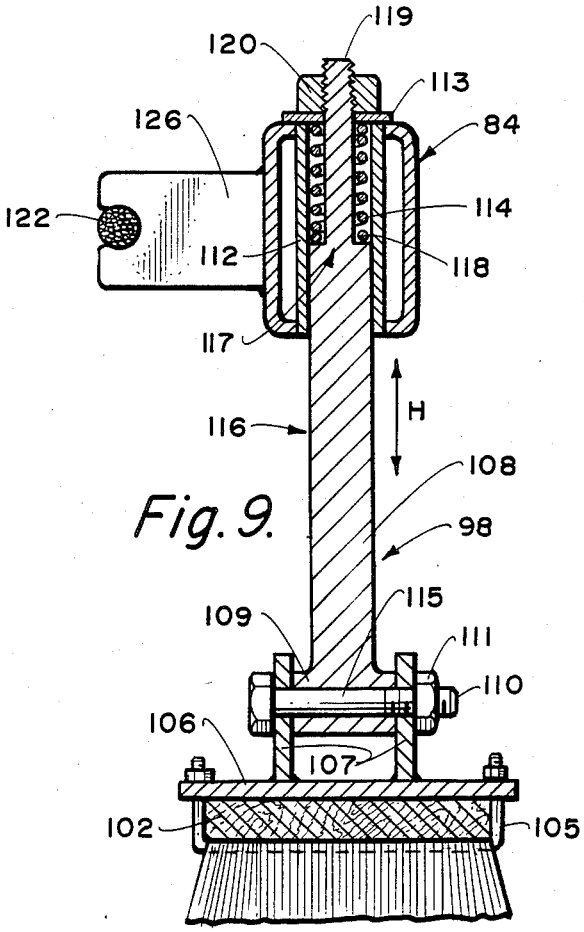
Fig. 9.

ROAD COATING METHOD AND APPARATUS

BACKGROUND OF THE INVENTION

1. Field of the Invention

The present invention relates to the coating of road surfaces and, more particularly, to a system for applying paving fabric and oil to a pavement.

2. Brief Description of the Prior Art

Until discovery of the present invention, application of fabric to an oil coated pavement was accomplished in two separate steps. A tank truck with an oil spreading apparatus was used to apply hot oil to a road surface. A separate vehicle, such as a tractor, with a loader assembly carrying a roll of paving fabric followed behind the tank truck. The tractor driver would guide the assembly to unroll the fabric onto the oil in the desired alignment with the street and/or edge of previously applied fabric. A series of brushes were used to push the fabric into the oil.

The above sequence required two vehicle operators plus associated helpers for each operation. Capital expense, maintenance costs and labor were very high. Oftentimes, before the fabric could be pressed into the hot oil, the oil would become too cool and viscous to permit proper adherence. In such cases, recoating of the street or the use of additional equipment to soften the oil was needed.

SUMMARY OF THE INVENTION

The present invention provides an apparatus and method for the simultaneous application of oil and fabric to a roadway. An assembly holding a paving fabric roll is secured to the frame of a vehicle containing a supply of paving oil. As the vehicle moves in a predetermined path on a roadway, the oil is applied while a sheet of fabric is drawn from the roll and pressed into the oil. The sheet is directed by a fabric guide and press assembly that includes a guide shaft and fabric press means.

A unique framework means permits the entire guide and press assembly to be releasably attached to an oil spreader unit on the vehicle. The fabric roll assembly can also be disassembled and includes a boom that can be folded for vehicle transport.

BRIEF DESCRIPTION OF THE DRAWINGS

FIG. 5 is an enlarged fragmentary elevation view taken along lines 5—5 of FIG. 4.

FIG. 6 is a cross-sectional view taken along lines 6—6 of FIG. 5.

FIG. 7 is a side elevation view taken along lines 7—7 of FIG. 6.

FIG. 8 is a cross-sectional view taken along ines 8—8 of FIG. 3.

FIG. 9 is a cross-sectional view taken along lines 9—9 of FIG. 3.

DESCRIPTION OF THE PREFERRED EMBODIMENTS

Figure 1:
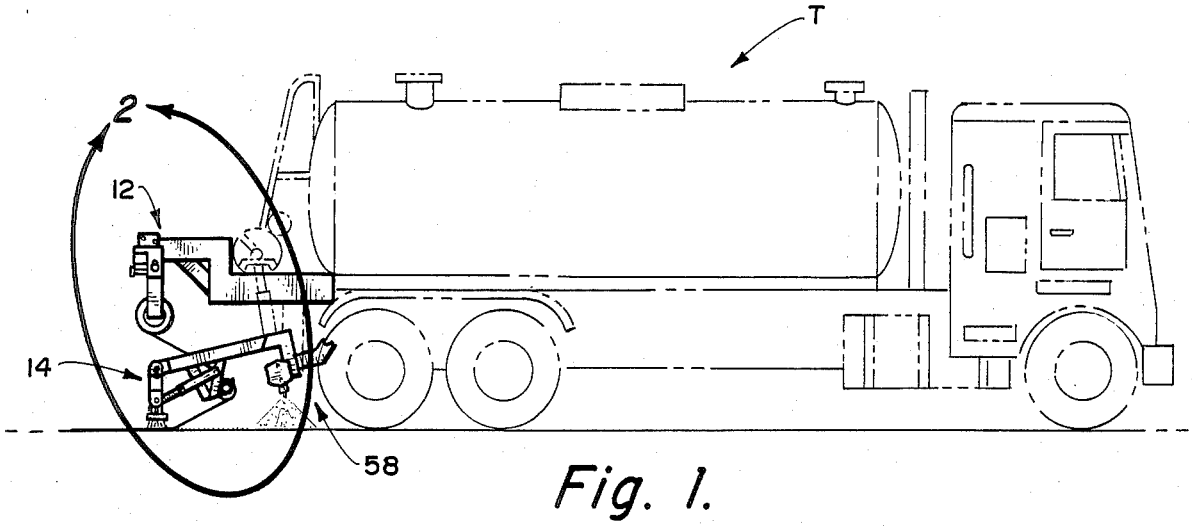
FIG. 1 is a side elevation view of a tank truck in phantom to which is attached the road coating apparatus of the present invention.

With reference now to the drawings, a roll engagement assembly 12 is shown at the rear of oil tank truck (T). The assembly engages a roll of paving fabric and permits the unwinding of such into a fabric guide and press assembly 14. Both assemblies cooperate with an oil spreader unit 58 in a continuous operation to cover a roadway with an oil and fabric coating.

The roll engagement assembly is secured to truck frame extensions 16,17 which extend upwardly and outwardly from truck frame (F). The end of each extension includes plate pads 18,18 upon which boom 20 rests. Each plate includes bars 24,24 extending axially from the end of each extension beneath the boom. Fasteners shown as bolts/nuts 25,25 extend through the boom and plate pads to secure the boom and assembly together.

The boom extends transversely and horizontally across the back of the trucks and preferably perpendicular to the truck longitudinal axis. Most conveniently, the boom centerpoint 22 is coextensive with the truck axis and is located halfway between the connection with extensions 16,16.

Figure 14:
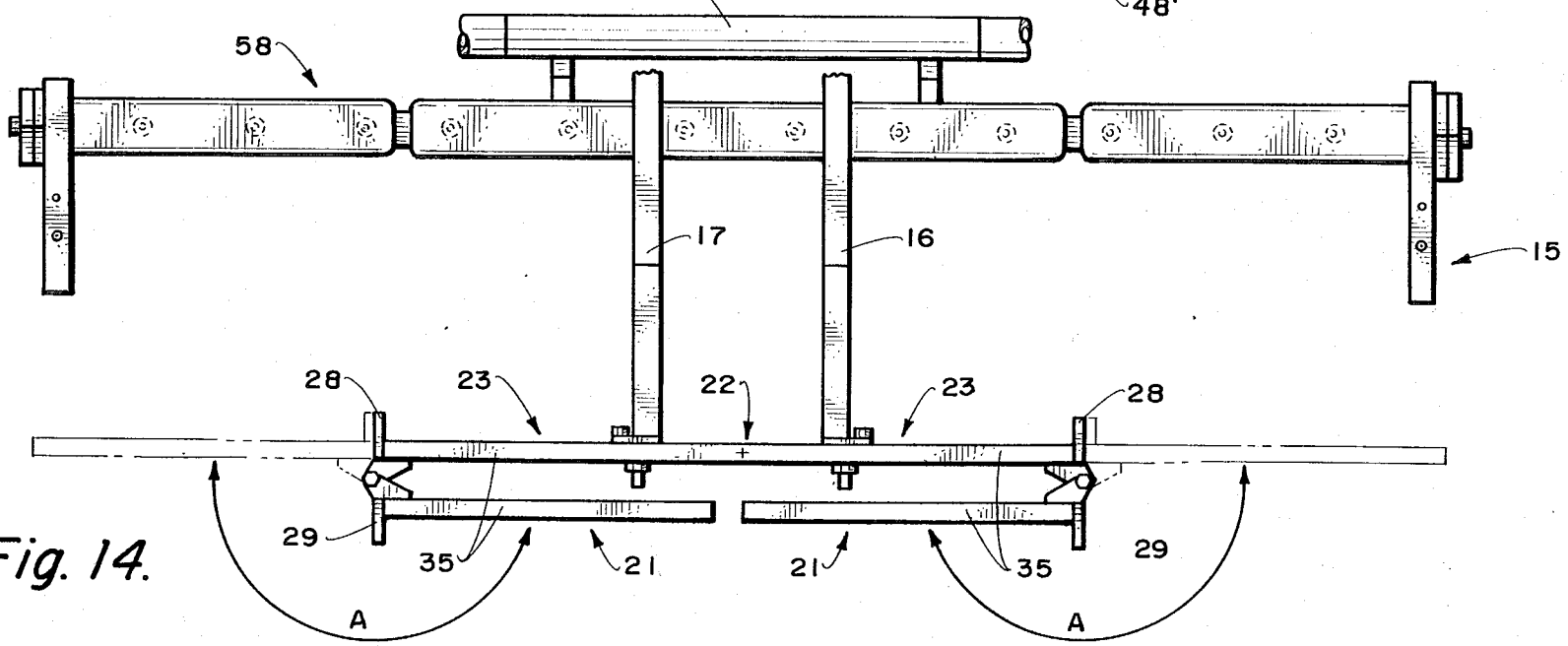
FIG. 14 is a top plan view similar to FIG. 4 showing rotation of the boom outer portions.

Positioned radially outward in opposing directions from the centerpoint are hinge means 30,30. The hinge means permit the outer portions 21,21 of the boom to be rotated inwardly in the direction of arrow A in FIG. 14 toward the center portion 23. In this manner, the overall apparatus width will not exceed the limits prescribed for travel on public roads. The hinge means are preferably located equidistant from centerpoint 22.

Each hinge means comprises a face plate 28 which is secured across an opposing end of the boom center portion 23. A mirror-image face plate 29 is secured across the inner end of boom outer portions 21,21. When the boom is in an unfolded operative position, each of the corresponding face plates abut each other. In such position, the plates are provided with securement means shown as bolt/nut fasteners 31,31 to prevent unwanted rotation of the outer portions.

Each hinge means further includes a pair of horizontal spaced-apart inner hinge brackets 32 extending between a pair of horizontal outer hinge brackets 33. Both pairs project from the outer face 35 of the boom. A hinge pin 34 extends perpendicularly through each pair of brackets and forms the pivot axis for each of the boom outer portions.

Located on the boom outward from each hinge is a slide connector means 38. Said means includes a sleeve that slidably engages the boom by overlying and loosely clasping at least a portion of the boom circumference. It includes an attachment means, shown as box part 40 and box pin 41, for releasable connection with roll arm 42. The roll arm comprises a straight structural member having an upper promixal end 45 and a lower distal end 45'.

Box part 40 is fixed to the sleeve and includes a downwardly facing opening 44 which receives proximal end 45 of the roll arm. The box and proximal end are provided with corresponding openings 46 for insertion of box pin 41. In this way, the arm may be conveniently removed for transport or replacement.

Distal end 45' of the roll arm is provided with an inwardly directed roll insert means shown as cone member 43. The cone member center axis is aligned with the boom longitudinal axis and its apex 47 is inwardmost to facilitate insertion into the tubular core 49 of a roll of paving fabric 48. The cone member includes inner bearings for rotation about an inner shaft (not shown) extending from the roll arm.

Axial movement of the cone member is accomplished by drive means operating upon slide connector 38 to cause it to slide along boom 20 in the direction of arrows B in FIG. 5. The drive means may comprise any one or combination of, electrical, mechanical, pneumatic and hydraulic devices known in the art to apply motive forces. The devices may be operated manually, as with a jacking device, or by a controlled power source.

In the embodiment shown, the drive means comprises a hydraulic cylinder 50 secured to the boom by stationary bracket 51. The bracket is located outwardly from hinge 30 between the hinge and slide connector 38. Plunger arm 52 is connected to the slide connector by pin fastener 53. A power source and actuating means (not shown) provide hydraulic fluid through hoses 54,54 to cylinder 50 to cause reciprocation of arm 52. This results in the movement of slide connector 38 and concomittant movement of cone member 43 into and out of engagement with the paving fabric roll. See arrows C in FIG. 5.

It will be appreciated that the above fabric roll engagement assembly includes an identical counterpart on an opposing portion of the boom with the power source and actuating means preferably common to both. As such, the above description pertaining to one assembly applies to both and movement of one cone member is matched by an equal and opposite movement of its counterpart. In this way opposing ends of the fabric roll will be simultaneously engaged and released as desired by an operator.

Figure 12:
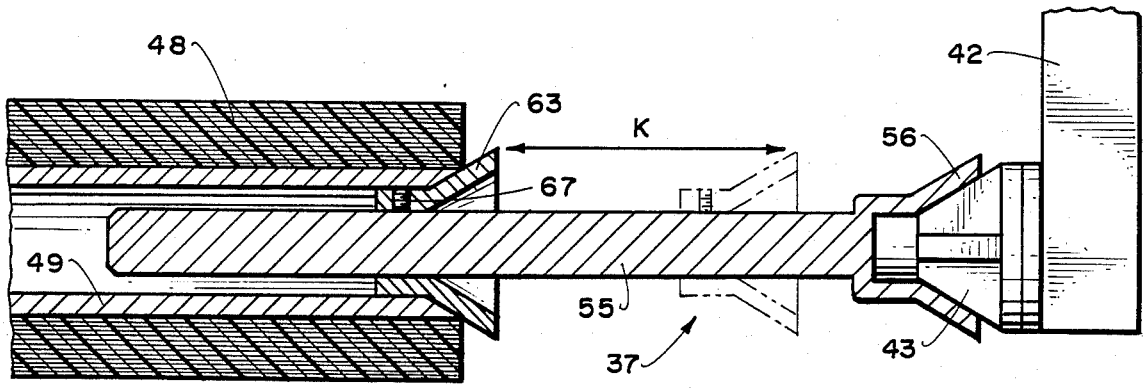
FIG. 12 is a cross-sectional view of a cone member adapter for insertion into the core of damaged or shortened fabric rolls.

On occasion, the tubular core 49 may be damaged or become wet and too weak to fully support the weight of a full roll of fabric. Also, it may become necessary to utilize fabric rolls of shortened length for narrow roads or pathways. In such cases, the roll insert means will include the use of an adapter 37 shown in FIG. 12.

The adapter comprises a shaft 55 with a free end sized to slide into the core a distance sufficient to be supportive thereof. It includes an opposing flared end 56 for engagement with cone member 43. The shaft includes a slidable collar 63, shaped as a truncated cone, to engage the end of core 49 by movement in the direction of arrow K in FIG. 12. The collar includes set screw 67 to secure it in the proper axial position on the shaft.

Opposing end 56 is shaped to engage the correspondingly shaped cone member 43 and is held thereby in the same way as with core 49. The adapter may be used on both ends of a fabric roll not only for damaged cores but to center or otherwise shift rolls of shortened length with respect to boom centerpoint 22.

The invention includes a fabric guide and press assembly 14 which is adjustably and releasably attached to an oil spreader unit 58. It is positioned generally below the roll engagement assembly 12. The oil spreader unit is known in the art and includes a hollow beam 59 with sealed end caps 71 through which hot paving oil flows. Nozzles 60 are spaced-apart along the bottom of the beam and the hot oil exits therefrom in the form of a spray 57 to evenly coat the road surface below.

Figure 2:
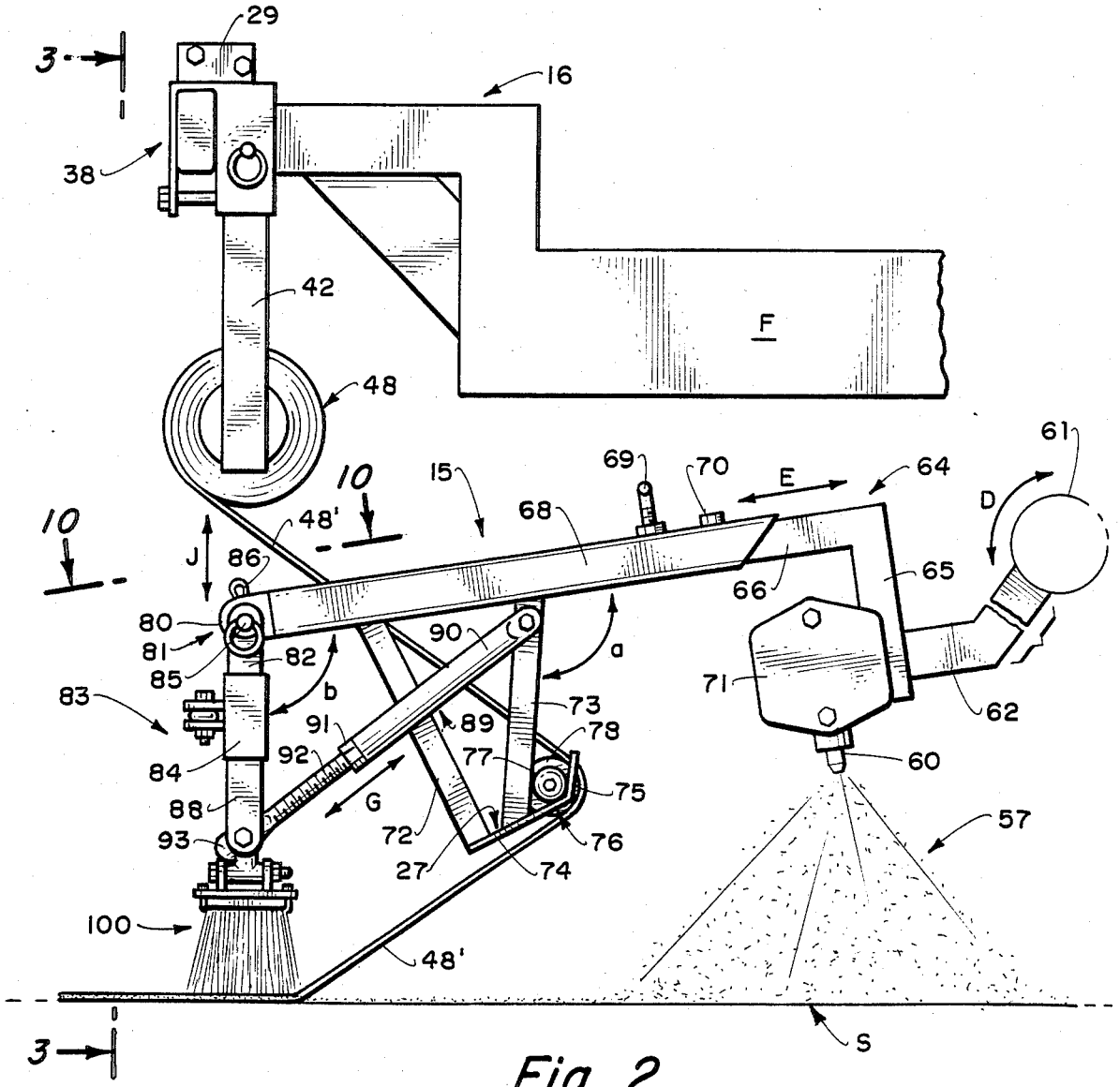
FIG. 2 is an enlarged fragmentary side view of the appratus taken along line 2 of FIG. 1.
Figure 3:
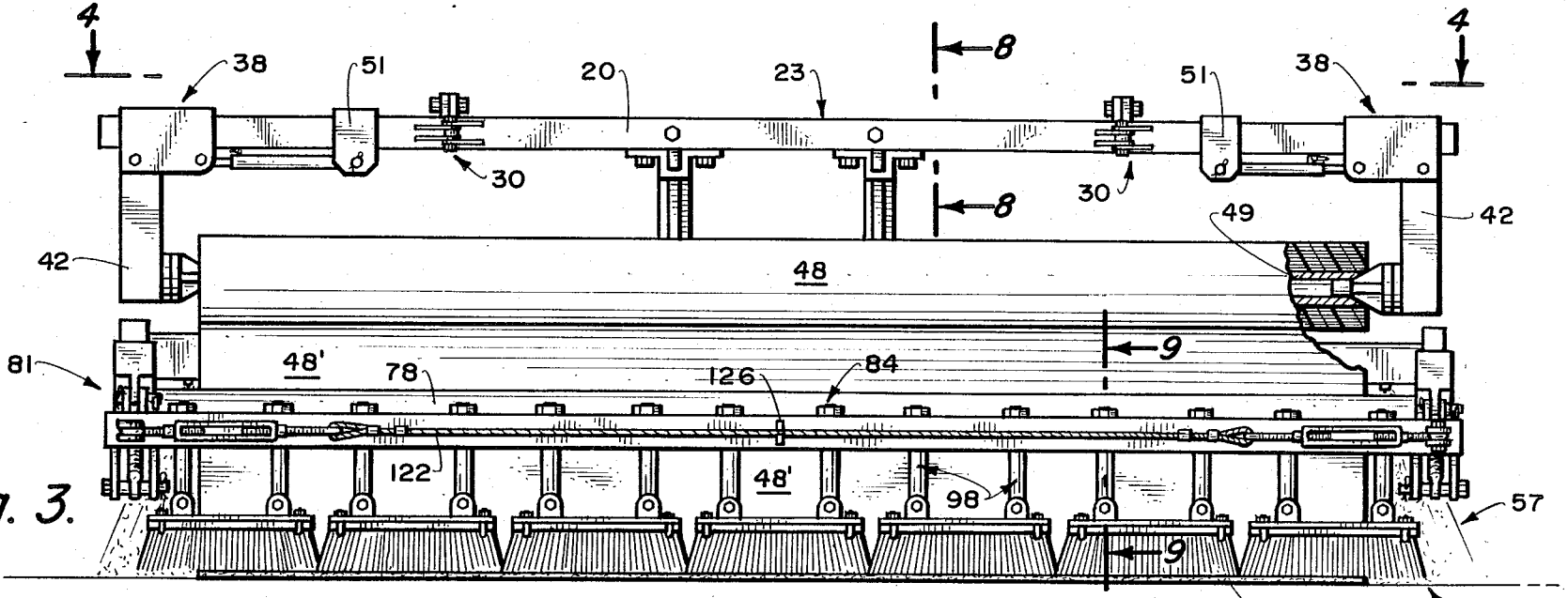
FIG. 3 is an end elevation view of the apparatus of FIG. 2 taken along lines 3—3 of FIG. 2.
Figure 4:
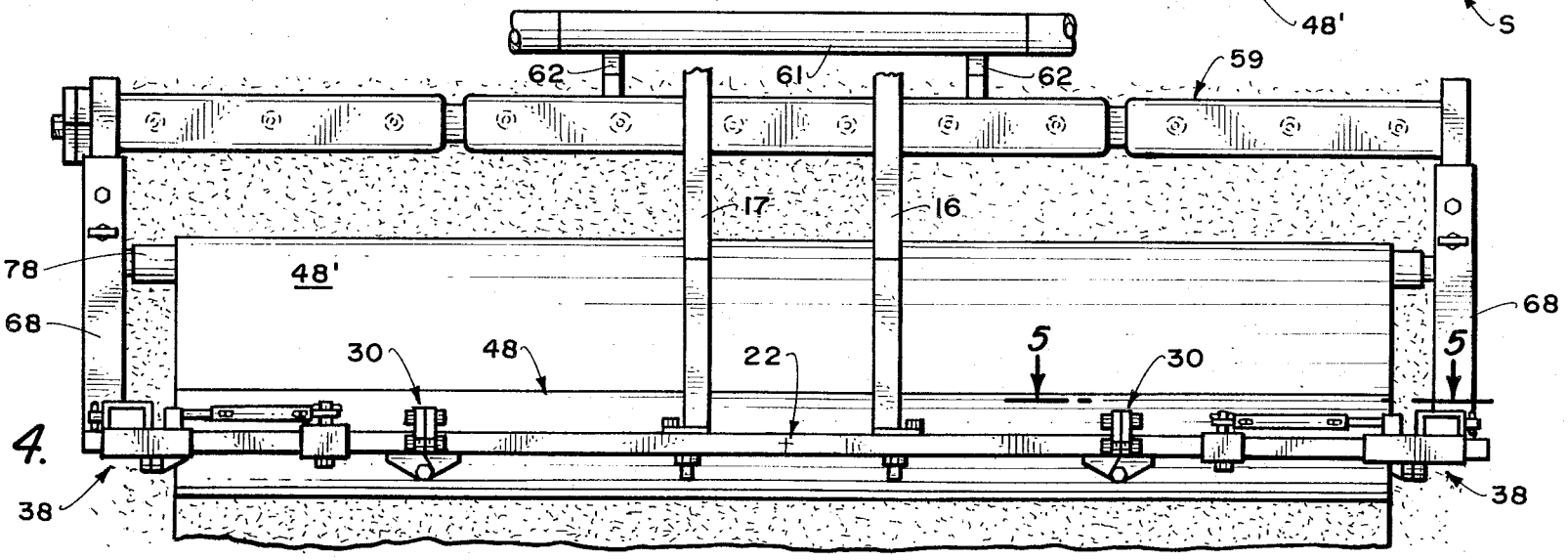
FIG. 4 is a top plan view taken along lines 4—4 of FIG. 3.
Figure 10:
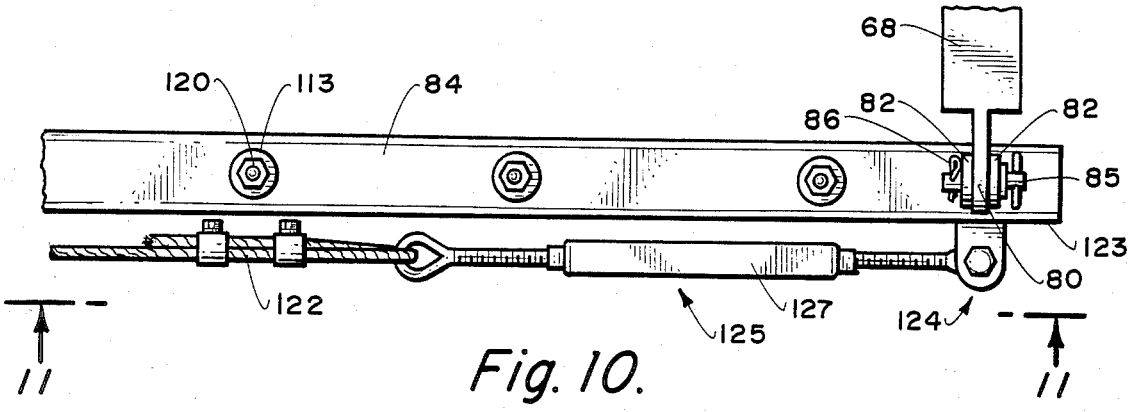
FIG. 10 is a fragmentary top plan view taken along lines 10—10 of FIG. 2.
Figure 11:
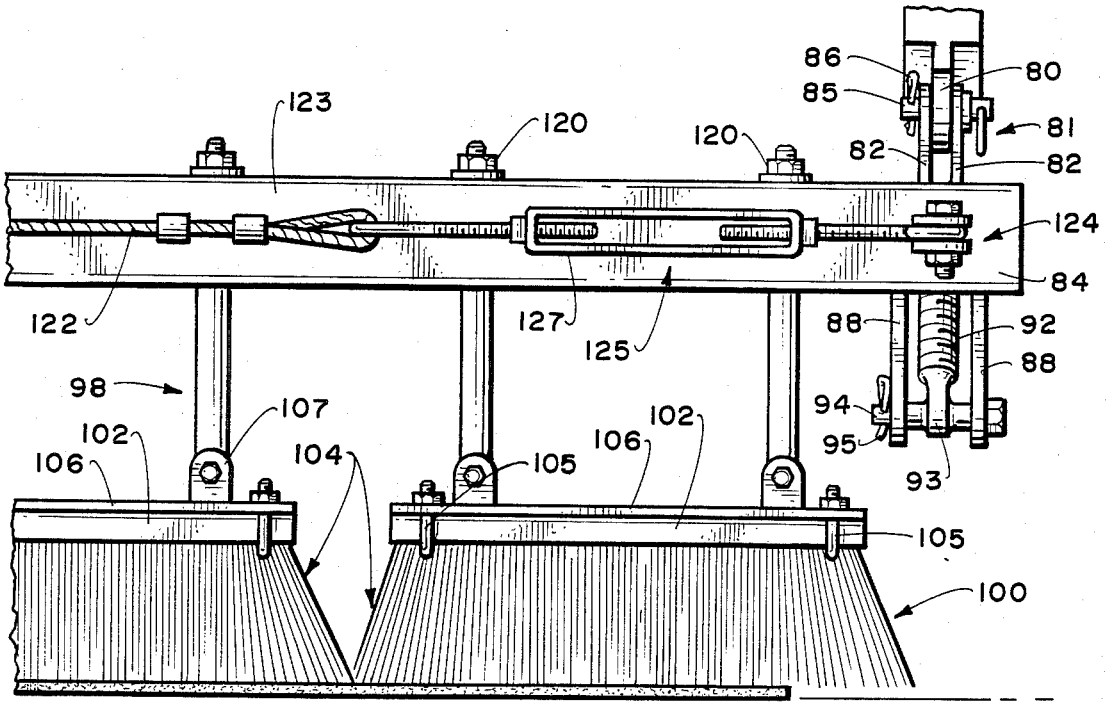
FIG. 11 is a side elevation view taken along lines 11—11 of FIG. 10.

The beam is raised and lowered by rotation of truck shaft 61 through connecting arms 62,62 as shown by arrows D in FIG. 2. As will be apparent hereinafter, movement of the beam 59 results in a like movement of the fabric guide and press assembly as shown by arrows J.

Framework means 15, which is dismantlable for storage, is used to attach the fabric guide and press assembly to the oil spreader beam 59. Said means comprises an angle bar 64 with a first leg 65 fixed to opposing ends of the beam. A second leg 66 extends over the oil beam with the inner hollow end of support member 68 telescoping over the end portion thereof. The support member may be axially adjusted, as shown by arrows E in FIG. 2, and secured to leg 66 by set screw means 69. The set screw means may include safety pin 70 that extends through corresponding openings in the support member and leg to prohibit disconnection in case the set screw loosens.

The support member has secured thereto mount means for receiving opposing ends of guide shaft 78. The mount means comprises first brace 72 and second brace 73 extending downwarly from each support member. The braces incline toward each other and terminate at a juncture 27 with coextensive ends adjacent each other. Underlying plate 74, which is secured across the bottom of each brace end, includes an extension 75 that projects beyond the juncture. Preferably, it extends inwardly and upwardly from the bottom of brace 73. The extension is spaced below the support member proximate its midportion and provides, in conjunction with brace 73, a somewhat U-shaped receptacle 76 for guide shaft 78.

The guide shaft is provided with opposing ends journaled to bearing sleeves 77,77. The sleeves are seated within respective mounts 76,76 so that the shaft itself will be free to rotate. The shaft is maintained in the mounts primarily by gravity. However, when the paving fabric sheet 48' is drawn thereover and pulled toward the road surface (S) during operation, a downward and outward force against brace 73 and extension 75 will occur to further maintain its seatment within the mounts. In this regard, note that angle "a" shown in FIG. 2 between brace 73 and support member 68, should preferably be 90° or greater to inhibit the sleeves 77,77 from lifting out of the mounts.

Extending axially from the outer end of each support member is a pivot means 81. The pivot means comprises a flat part 80 that fits between a pair of spaced-apart ears 82,82 which extend upwardly from the top surface of broom beam 84. Ear pin 85 extends through corresponding openings in the ears and flat part to pivotally anchor the beam to the support member. Cross pin 86 extends through an orifice at the end of ear pin 85 to prevent unwanted withdrawal from the ear and flat part openings.

A pair of spaced-apart bracket parts 88,88 extend downwardly from the underside of the beam 84 and connect with an axial adjustment means. As shown, the means comprises an internally threaded tube 90 which is hingedly connected to brace 73. A shaft 92, having an end with external threads corresponding to the tube threads, engages the tube thereby. Locknut 91 is threaded on the shaft 92 to tighten against the tube end and prevent the shaft from loosening.

The opposing end 93 of the shaft is flattened and includes an opening therethrough. It connects between the brackets 88,88 with bracket pin 94 extending through corresponding bracket openings and the flattened shaft end. A cross pin 95 extends through an orifice in the end of the pin to secure it from release.

From the above, it can be seen that when shaft end 93 is loose of brackets 88,88, it can be rotated into and out of tube 90. This action results in a change of its axial extent, as shown by arrows G in FIG. 2, and thereby permits adjustment of the angle "b" when reconnected to the brackets 88,88.

Pivot means 81 joins support member 68 to fabric press means 83. The fabric press means comprises broom beam 84 which is mounted by connector means 98 to embedding means shown as longitudinally aligned and spaced-apart brushes 100. Each brush includes a base 102 from which extend bristles 104. The bristles are relatively stiff and flare downwardly and outwardly from the base. Each brush is preferably juxtapositioned so that bristles at opposing sides will contact the side bristles of an adjacent brush. In this end-to-end manner, a linear continuum of bristles below beam 84 will occur to effectively operate against fabric 48' and cause its even bubble-free embedment into the hot oil.

Figure 13:
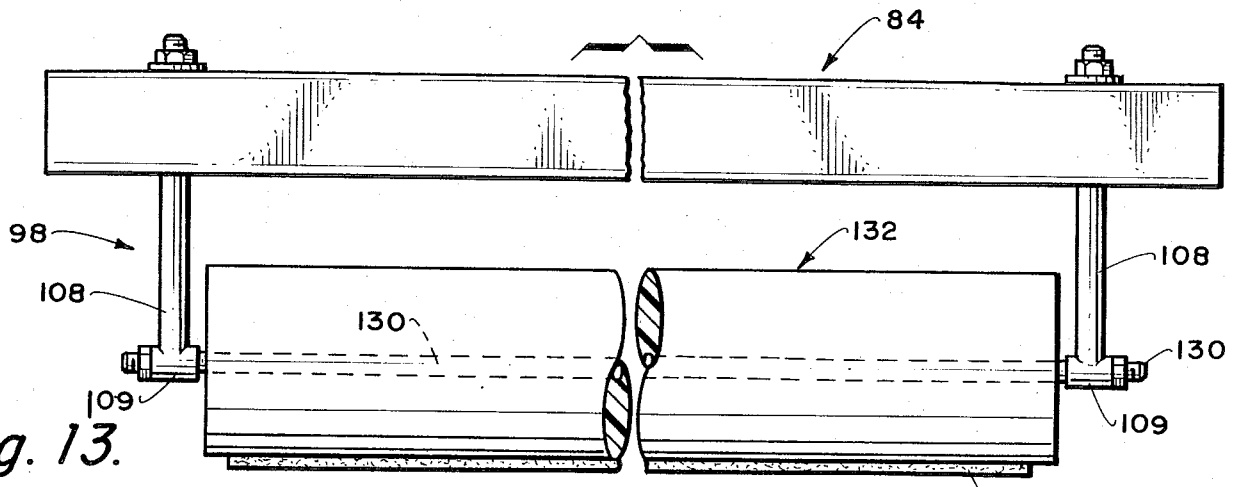
FIG. 13 is an alternative embodiment of embedding means depicting a roller(s) in place of brushes.

For purposes of the present invention, it will be understood that embedding means may comprise one or a series of roller units in place of, or in combination with, brush units 100. Note FIG. 13 wherein cross-portion 109 secures a roller unit comprising axle 130 supporting roller 132. The axle may extend the length of beam 84 or be in the form of segmented lengths for multiple rollers. The roller units are aligned with the beam and may be interspersed between the broom units. They may be weighted in addition to the biasing action from the connector means 98 as hereinafter described.

The connector means 98 preferably includes a biasing mechanism that will facilitate contact of the bristles with the fabric over contoured or irregular road surfaces (S). As best shown in FIG. 9, the connector means includes a pair of U-bolts 105 which secure brush base 102 to a base plate 106. The base plate has two pairs of spaced-apart connector elements 107 extending from opposing sides of the plate upper surface. The cross-portion 109 of a T-bar 108 fits across the pair of connector elements. The cross-portion has an opening 115 through the longitudinal extent thereof and bolt 110 passes through the opening and corresponding openings in each element 107 to form a connection. Nut 111 is used to secure the bolt.

Broom beam 84 is shown as comprising a box beam with a series of space-apart center openings through its upper and lower wall thicknesses. Corresponding upper and lower openings are joined with a pipe section 112 traversing the beam interior. A washer 113 with an opening of slightly less diameter than the upper opening is secured concentrically about the upper opening to provide an inner abutment for spring 114. T-bar 108 includes a stem portion 116 having an upper section 117 of reduced diameter and an annular shoulder 118.

The upper end 119 of the stem portion is threaded for engagement with stop nut 120. Spring 114 encircles the upper section 117 and is held in a compressed station between washer 113 and shoulder 118 by securement of the stop nut. As so arranged, stem 116 will reciprocate within pipe section 112, as shown by arrows H in FIG. 9, in reaction to vertical movement of brush 100. Such movement will be against the bias of spring 114, the strength of which can be adjusted by tightening or loosening nut 120. Rotation of the stop nut also allows for minor adjustment in the vertical placement of the broom. This is desirable because it provides a way to compensate for bristle wear.

To help insure that the broom beam 84 is straight and presents a uniform placement of the fabric on a road surface, a beam alignment means is provided. This comprises a tensioning cable 122 which extends along outer face 123 of the beam. Connector parts 124 are located at each end of the face to secure opposing ends of the cable. Cable guide parts 126 may also be used on the face to maintain the cable in place.

Attached to the connector parts, at least at one end of the beam, is turnbuckle 125. Rotation of the turnbuckle link 127 allows tensioning of the cable in a manner well known in the art. This helps to eliminate beam bowing due to frictional drag of the brushes on the fabric.

Operation:

Upon arrival at the job site, it is expected that the road surface will have been cleaned and all large cracks and holes filled. The truck tank will contain hot asphaltic paving oil with circulating pump, heating means, hydraulic and overall control systems in operation.

The roll engagement assembly, previously disassembled and stored on the truck, is put into operative condition. This is accomplished by swinging boom outer portions 21 about hinges 30 into alignment with center portion 23 and securing them in place with the face plate fasteners 31. Roll arms 42 with attached cone members 43 are inserted into box openings 44 and secured with box pins 41. Fabric roll 48 is lifted into axial alignment with apexes 47 and the hydraulic cylinders 50 are activated to move slide connectors 38 with their cone members 43 toward each other until they engage tubular roll core 49. If one or two adapters 37 are being used, these are initially inserted into the core 49 with the collar 63 being longitudinally adjusted on shaft 55 against the core ends so that flared shaft end 56 may be properly engaged within the axial distance range permitted by the length of hydraulic cylinder plunger arm 52.

With the oil spreader unit in operating position, the fabric guide and press assembly, previously disassembled and stored on the truck, is put into operative condition. Support members 68 are slid upon leg 66 of angle bar 64 and secured thereto by screw 69 and pin 70. Broom beam 84 with attached brooms is lifted until flat part 80 is between ears 82. Alternately, the brooms may be placed on the road surface and truck shaft 61 rotated to lower member 68 for positioning the flat part between the ears.

As above disposed, ear pin 85 is inserted through corresponding openings in the flat part and ears and locked in place with cross pin 86. The ear pins form a pivot connection for the broom beam with the angular displacement thereof, shown by angle "b", being set by axial adjustment means 89.

At this point, it may be desirable to longitudinally adjust the support member as shown by arrows E with the set screw 69 and pin 70. Spacing from the spray nozzles 60 and angulation of the fabric relative to the road surface, as dictated by fabric characteristics, are variables to be considered. With the brooms in the desired orientation, shaft 92 is rotated until end 93 can be connected between bracket parts 88 by pin 94 which is secured with cross pin 95.

The guide shaft 78 may be positioned in place either before or after the broom beam and brushes are assembled. The shaft has a predetermined length which is dictated by the maximum width of paving fabric 48'. Also, the overall width of the fabric guide and press assembly is sized to accommodate said fabric since the end-to-end brushes must also be capable of pressing against the entire fabric width as it contacts the road surface. And, the mounts 76 must be spaced-apart in accordance with the roller shaft length so that only the bearing sleeves will be in contact therewith. In this regard, it will be noted that angle bars 64, which support the entire fabric guide and press assembly, extend from opposing ends of the oil beam 59. The outermost spray nozzles will disperse hot oil to a surface area slightly beyond the outer edge of the fabric as it contacts the surface. This is to insure that the fabric will be entirely embedded therein.

With at least the support arms 68 in place and longitudinally adjusted by set screw 69 and pin 70, the roller shaft is lifted into place with opposing bearing sleeves 77 engaging respective mounts 76 formed by upturned bottom plate extensions 75. As so disposed, the shaft will freely rotate with the sleeves being stationary by weight of the shaft.

The leading end of the fabric roll will be drawn inwardly and drawn over the shaft and beneath the brushes until it can be adhered to an oiled surface at a predetermined starting line or adjacent the trailing end of a previously laid fabric. It is expected that oil will exist beneath the brushes up to the nozzle spray zone from previous application or by initial manual application to permit adherence of the fabric during the initial movement forward of the tank truck.

Hot oil spray will be started simultaneous with forward movement of the truck. Fabric will be drawn continuously from the roll in direct relation to the distance traveled by the truck as a result of the fabric's adherence to the oil on the road. As the fabric unrolls, the brushes will push it into the oil and cause it to become soaked therewith. Coordination of truck speed, oil temperature, viscosity, spray nozzle spacing and oil application rate, as well as the fabric thickness, texture and strength is accomplished in a manner known in the art and is not part of this invention.

The truck will be guided in a controlled manner so that the fabric will be applied to the road surface directly adjacent the side edge of a previously applied fabric and/or in a line as determined by the road direction. As one roll of fabric is exhausted, the above process can be repeated with successive rolls.

Upon completion of a job, the parts exposed to oil are cleaned with solvent and the various assemblies are dismantled and stored in reverse of the above-described assembly steps. The outer portions of boom 20 are folded and secured against the boom midportion and the oil beam is hydraulically folded and secured for travel to the next job site.

While the invention has been described with respect to preferred embodiments, it will be apparent to those skilled in the art that various modifications and improvements may be made without departing from the scope and spirit of the invention is not limited by the specific embodiments, but only by the scope of the appended claims.

We claim:

1. An apparatus for coating a roadway with oil and a layer of paving fabric dispensed from a roll having a core by means of a moving vehicle with a frame to which is attached an oil spreader unit including an elongated oil beam with oil spraying means for dispersing oil onto the roadway in a continuous manner including application of a continuous layer of paving fabric onto the oil comprising:

a roll engagement assembly comprising a boom secured to the vehicle frame transverse of the vehicle longitudinal axis and slide connector means slidably engaged to each opposing outer portion of said boom including attachment means for connection with a roll arm for releasable engagement with the roll of paving fabric;

drive means for moving said slide connector means axially along said boom; and, a fabric guide and press assembly connected to said oil beam by framework means, said fabric guide and press assembly comprising a guide shaft aligned coextensive with said boom and, fabric press means adjacent said guide shaft for pressing fabric from said roll against the roadway, said framework means comprising a support member releasably connected to each opposing end of said beam, mount means secured to said member for supporting the guide shaft and pivot means joining each member with said fabric press means, said fabric press means including a broom beam joined to said support member by said pivot means and connector means for attaching fabric embedding means.

2. The apparatus of claim 1 wherein said embedding means comprises any one or combination of brush and roller units.

3. The apparatus of claim 2 wherein said connector means comprises a downwardly biased bar reciprocably mounted within the broom beam with a lower cross-portion for connection with a brush unit or roller unit.

4. The apparatus of claim 3 wherein said lower cross-portion is connected to a base plate from which extend brush units.

5. The apparatus of claim 1 including an axial adjustment means interconnecting the support member and broom beam to adjust the angular disposition therebetween.

6. The apparatus of claim 5 wherein the axial adjustment means comprises a tube in axial threaded engagement with a shaft.

7. The apparatus of claim 5 wherein said pivot means comprises a flat part at the outer end of each support member joined to space-apart ears extending from opposing ends of the broom beam with an ear pin.

8. The apparatus of claim 1 wherein said framework means includes an angle bar fixed to each opposing end of said support member which includes an outer end that axially adjustably attaches to a corresponding angle bar.

9. The apparatus of claim 8 wherein the outer end of said support member is hollow and telescopes over an end portion of the angle bar and is secured thereto by set screw means.

10. The apparatus of claim 1 wherein the mount means includes a receptacle connected to each support member for receiving corresponding opposite ends of the guide shaft.

11. The apparatus of claim 10 wherein said opposite ends of the guide shaft include bearing sleeves into which the shaft is journaled.

12. The apparatus of claim 10 wherein the mount means includes a first and second brace inclined from the support member toward each other to a bottom end juncture that includes an underlying plate.

13. The apparatus of claim 12 wherein said plate includes an extension that projects beyond and upwardly from said juncture forming the receptacle with the bottom end of one of said braces.

14. The apparatus of claim 1 wherein said roll arm comprises a structural member with a distal end that includes roll insert means for engagement with the roll of paving fabric.

15. The apparatus of claim 14 wherein the roll arm includes a proximal end and the attachment means comprises a box part with an opening for releasable connection with said proximal end.

16. The apparatus of claim 15 wherein the slide connector means comprises a sleeve that overlies at least a portion of the boom circumference with the box part fixed to said sleeve.

17. The apparatus of claim 14 wherein the roll insert means comprises a cone member having an inwardly directed apex with a center axis in alignment with the longitudinal axis of said boom.

18. The apparatus of claim 17 wherein the roll insert means includes an adapter comprising an elongated shaft with a free end for insertion into the core of the roll of paving fabric and an opposing end for engagement with said cone member, including a collar axially adjustable on said shaft for abutment against an end of the roll of paving fabric.

19. The apparatus of claim 1 wherein said drive means comprises a hydraulic cylinder fixed to said boom having a reciprocable plunger arm secured to the slide connector means.

20. The apparatus of claim 14 wherein the boom is an elongated support element segmented into a center portion with opposing outer portions hingedly connected thereto.

* * * * *